US011388800B2

(12) United States Patent
Chou et al.

(10) Patent No.: US 11,388,800 B2
(45) Date of Patent: Jul. 12, 2022

(54) POWER SUPPLY FOR LIGHT-EMITTING DIODE AND OPERATING METHOD THEREOF

(71) Applicant: DELTA ELECTRONICS, INC., Taoyuan (TW)

(72) Inventors: Ching-Ho Chou, Taoyuan (TW); Yung-Chuan Lu, Taoyuan (TW)

(73) Assignee: DELTA ELECTRONICS, INC., Taoyuan (TW)

( * ) Notice: Subject to any disclaimer, the term of this patent is extended or adjusted under 35 U.S.C. 154(b) by 300 days.

(21) Appl. No.: 16/848,836

(22) Filed: Apr. 15, 2020

(65) Prior Publication Data

US 2021/0092814 A1 Mar. 25, 2021

(30) Foreign Application Priority Data

Sep. 20, 2019 (CN) ..... 201910893548.6

(51) Int. Cl.
*H05B 45/34* (2020.01)
*H05B 45/38* (2020.01)

(52) U.S. Cl.
CPC ..... *H05B 45/34* (2020.01); *H05B 45/38* (2020.01)

(58) Field of Classification Search
CPC ..... H05B 45/30; H05B 45/34; H05B 45/38; H05B 47/10
See application file for complete search history.

(56) References Cited

U.S. PATENT DOCUMENTS 9,590,512 B2 3/2017 Yonezawa et al.
2011/0260617 A1* 10/2011 Tanaka ..... H05B 45/48 315/307

FOREIGN PATENT DOCUMENTS

CN 100384067 C 4/2008
TW I556560 B 11/2016

* cited by examiner

*Primary Examiner* — Jimmy T Vu
(74) *Attorney, Agent, or Firm* — CKC & Partners Co., LLC

(57) ABSTRACT

An operating method for a light-emitting diode (LED) power supply includes the following operations: controlling an output voltage to be a first voltage by a control circuit; detecting a load current by a detection circuit; maintaining the output voltage as the first voltage by a constant voltage control circuit when the load current is greater than zero, changing the output voltage from the first voltage to a second voltage by the control circuit when the load current is equal to zero, and the second voltage being greater than the first voltage.

12 Claims, 8 Drawing Sheets

POWER SUPPLY FOR LIGHT-EMITTING DIODE AND OPERATING METHOD THEREOF

RELATED APPLICATION

This application claims priority to China Application Serial Number 201910893548.6, filed Sep. 20, 2019, which is herein incorporated by reference.

BACKGROUND

Technical Field

The present disclosure relates to a power supply for a light-emitting diode (LED) and an operating method thereof. More particularly, the present disclosure relates to a power supply being able to correspond to two output voltages and an operating method thereof.

Description of Related Art

As compared with a T12 high output fluorescent tube, the power saving of an LED tube is close to 70%. The T12 high output fluorescent tube is therefore quickly replaced by the LED tube to serve as the light source of the advertisement box in the application of the advertisement box. The LED tubes can be mainly divided into 12V system and 24V system. Hence, the power supplies used for LED signs correspondingly are also divided into two series of 12V constant voltage output and 24V constant voltage output.

The power supplies for 12V and 24V LED signs are the mainstream products on the market. Lighting construction companies need to prepare inventory of power supplies for two output voltages to meet the inconsistent requirements of 12V and 24V LED light source systems. Two drivers need to be prepared for traditional usage to correspond to the 12V and 24V LEDs, thus causing inconvenience to the manufacturer's inventory.

For the foregoing reasons, there is a need to solve the above-mentioned problems by providing a power supply for a light-emitting diode and an operating method thereof.

SUMMARY

An operating method for a light-emitting diode power supply includes the following operations: controlling an output voltage to be a first voltage by a control circuit; detecting a load current by a detection circuit; and maintaining the output voltage as the first voltage by a constant voltage control circuit when the load current is greater than zero, and changing the output voltage from the first voltage to a second voltage by the control circuit when the load current is equal to zero, the second voltage being greater than the first voltage.

The present disclosure provides an operating method for a light-emitting diode power supply comprising the following operations: controlling an output voltage to be a first voltage by a control circuit; detecting a load current by a detection circuit; changing the output voltage from the first voltage to a second voltage by the control circuit when the load current is equal to zero, the second voltage being greater than the first voltage; and detecting the load current when the output voltage is changed from the first voltage to the second voltage, and maintaining the output voltage as the second voltage by a constant voltage control circuit when the load current is equal to zero.

The present disclosure further provides a power supply for a light-emitting diode comprising a constant voltage control circuit, a detection circuit, and a control circuit. The constant voltage control circuit is configured to control an output voltage of the power supply to be a first voltage or a second voltage, and the second voltage is greater than the first voltage. The detection circuit is configured to detect a load current. The control circuit is configured to control the constant voltage control circuit so as to change the output voltage to the first voltage or the second voltage according to the load current. When the output voltage is the first voltage, the constant voltage control circuit maintains the output voltage as the first voltage if the load current is greater than zero, and the control circuit changes the output voltage from the first voltage to the second voltage if the load current is equal to zero.

DETAILED DESCRIPTION

Furthermore, it should be understood that the terms, "comprising", "including", "having" and the like, used herein are open-ended, that is, including but not limited to. It will be understood that, as used herein, the phrase "and/or" includes any and all combinations of one or more of the associated listed items.

In this document, the term "coupled" may also be termed "electrically coupled," and the term "connected" may be termed "electrically connected." "Coupled" and "connected" may also be used to indicate that two or more elements cooperate or interact with each other. It will be understood that, although the terms "first," "second," etc., may be used herein to describe various elements or operations, these elements or operations should not be limited by these terms. These terms are used to distinguish one element or operation from another. For example, a first element or operation could be termed a second element or operation, and, similarly, a second element or operation could be termed a first element or operation, without departing from the scope of the embodiments.

Figure 1:
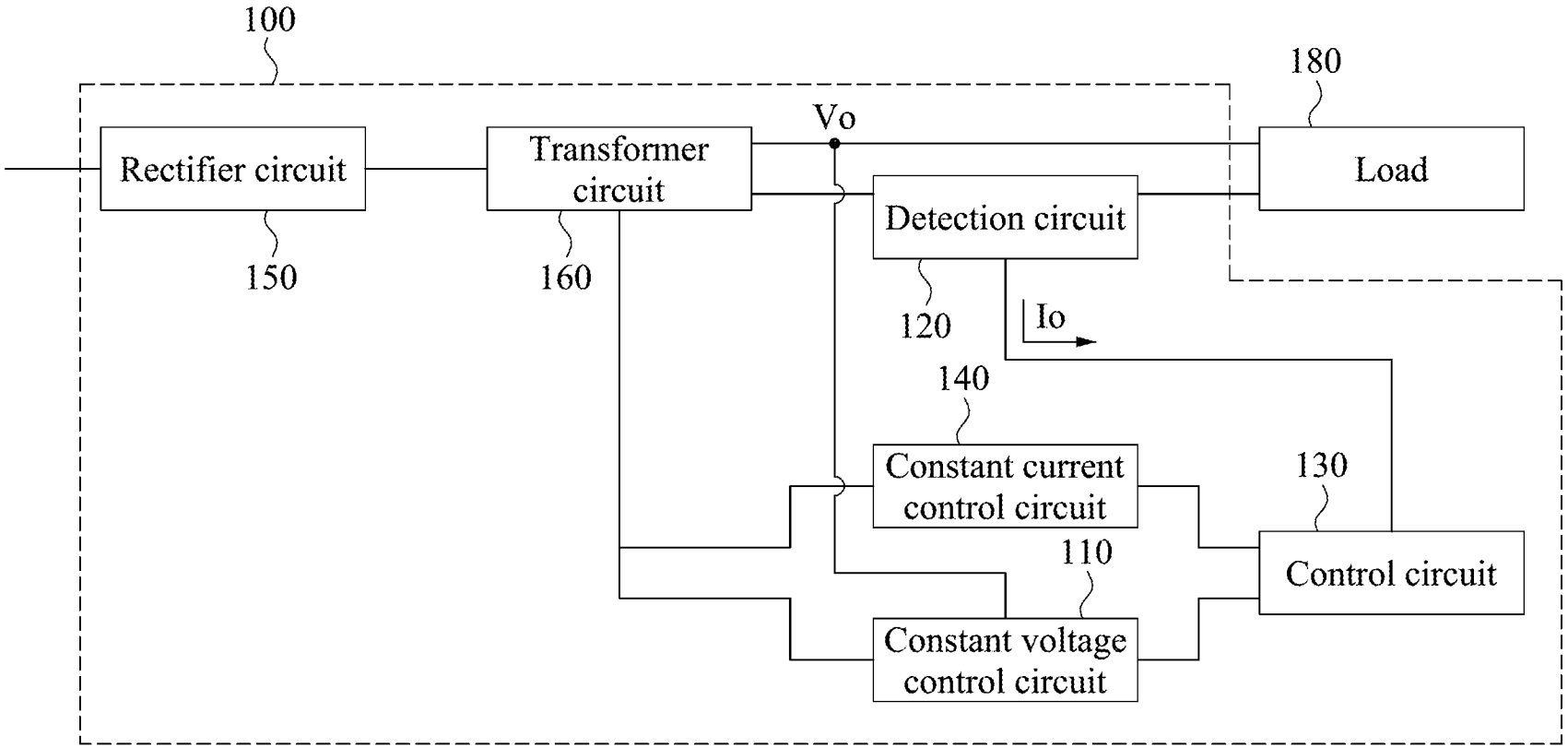
FIG. 1 depicts a functional block diagram of a power supply according to one embodiment of the present disclosure.

A description is provided with reference to FIG. 1. FIG. 1 depicts a functional block diagram of a power supply 100 according to one embodiment of the present disclosure. The power supply 100 includes a constant voltage control circuit 110, a detection circuit 120, a control circuit 130, a constant current control circuit 140, a rectifier circuit 150, and a transformer circuit 160. The power supply 100 is configured to provide an output voltage Vo to a load 180. In the present embodiment, the load 180 may be a 12V/60 W LED and a 24V/60 W LED.

The constant voltage control circuit 110 is configured to control the output voltage Vo of the power supply 100 to be a first voltage or a second voltage. The second voltage is greater than the first voltage. In the present embodiment, the first voltage may be 12V, and the second voltage may be 24 V. The detection circuit 120 is configured to detect a load current Io. In some embodiments, the detection circuit 120 may be a resistor that converts the load current Io into a load voltage and transmits the load voltage to the control circuit 130.

The control circuit 130 is configured to control the constant voltage control circuit 110 so as to change the output voltage Vo to the first voltage or the second voltage according to the load current Io. When the output voltage Vo is the first voltage, the constant voltage control circuit 110 maintains the output voltage Vo as the first voltage if the load current Io is greater than zero, and the control circuit 130 changes the output voltage Vo from the first voltage to the second voltage if the load current Io is equal to zero.

In some embodiments, the constant voltage control circuit 110 may be a comparison circuit or some other circuit having the function of comparing signals, and is configured to compare a magnitude of the output voltage Vo. When the power supply 100 seeks to output the first voltage and at this time the output voltage Vo is greater than or less than the first voltage (that is, the output voltage Vo is not equal to the first voltage), the constant voltage control circuit 110 compares the output voltage Vo with a reference voltage, and controls the output voltage Vo at a same potential as the reference voltage. The reference voltage may be provided by the control circuit 130. For example, the control circuit 130 provides the reference voltage of 12V, and the constant voltage control circuit 110 can control the output voltage Vo to be 12V.

The constant current control circuit 140 is configured to control a magnitude of the load current Io to avoid the situation that the electrical appliance is damaged because the load current Io is greater than a rated current. For example, when the load 180 is a 12V/60 W LED, the rated current of the load 180 is 5 A. When the load 180 is a 24V/60 W LED, the rated current of the load 180 is 2.5 A.

The rectifier circuit 150 is configured to convert an alternating current (AC) power source input to the power supply 100 into a direct current (DC) power source. In the present embodiment, the rectifier circuit 150 may be a full-wave rectifier circuit. The transformer circuit 160 is configured to convert the DC power source into the output voltage Vo required by the load 180, for example, 12V and 24V. In the present embodiment, the transformer circuit 160 may be a flyback converter, a boost converter, or other transformer circuit having the function of converting one DC voltage into another DC voltage.

Figure 2:
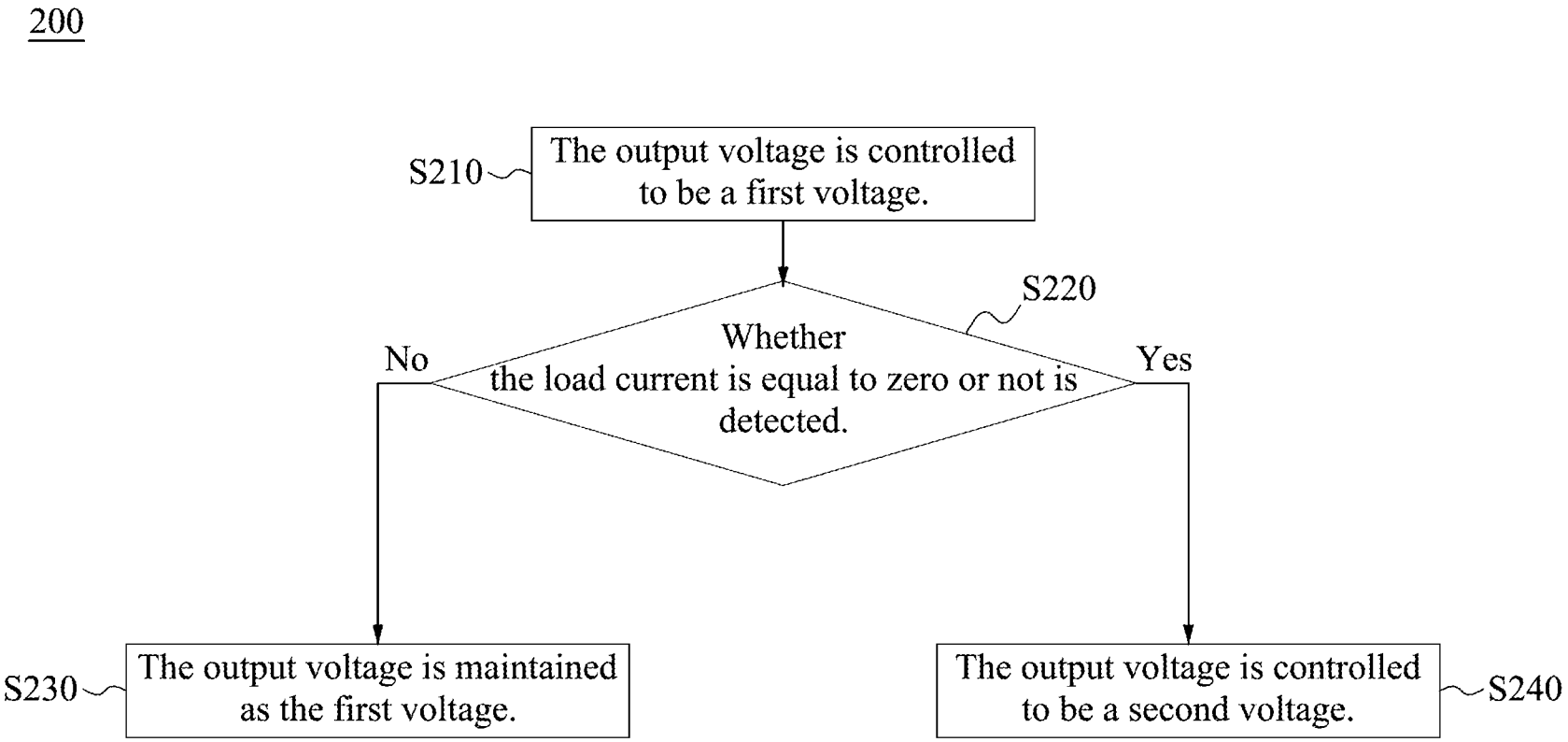
FIG. 2 depicts a flowchart of an operating method according to one embodiment of the present disclosure.

A description is provided with reference to FIG. 2. FIG. 2 depicts a flowchart of an operating method 200 according to one embodiment of the present disclosure. In order to facilitate the understanding of the operating method 200 shown in FIG. 2, a description is provided with reference to FIG. 1. The operating method 200 includes step S210, step S220, step S230, and step S240. A description is provided with reference to step S210. The control circuit 130 is used to control the constant voltage control circuit 110 so as to control the output voltage Vo to be a first voltage, such as 12V. A description is provided with reference to step S220. The detection circuit 120 is used to detect the load current Io of the load 180. When the load current Io is not equal to zero (for example, when the load current Io is greater than zero), step S230 is executed. When the load current Io is equal to zero, step S240 is executed.

In step S230, the constant voltage control circuit 110 is used to maintain the output voltage Vo as the first voltage. In step S240, the control circuit 130 is used to change the output voltage Vo from the first voltage to a second voltage. The second voltage is greater than the first voltage. For example, the second voltage may be 24 V.

In the above steps, the power supply 100 does not know in advance whether the load 180 is a 12V LED lamp or a 24V LED lamp. If the load 180 is the 12V LED lamp, the load current Io is greater than zero when the output voltage Vo supplied by the power supply 100 is the first voltage 12V. That is to say, there is the load current Io. The control circuit 130 in the power supply 100 detects the load current Io by using the detection circuit 120, and knows that the current Iload 180 is the 12V LED lamp. Under the circumstances, the load 180 matches the output voltage Vo. The output voltage Vo is thus maintained as the first voltage 12V, that is, the operation of step S230.

When the output voltage Vo of the power supply 100 is the first voltage 12V and the load 180 is the 24V LED lamp, the load current Io at this time is equal to zero. That is to say, there is no load current Io. The control circuit 130 in the power supply 100 cannot detect the load current Io by using the detection circuit 120, and knows that the current Iload 180 is the 24V LED lamp. Then, the control circuit 130 is used to change the output voltage Vo from the first voltage 12V to the second voltage 24V, that is, the operation of step S240.

In some embodiments, the operating method 200 further includes a step of detecting the load current Io when the output voltage Vo is changed from the first voltage to the second voltage, and maintaining the output voltage Vo as the second voltage by using the constant voltage control circuit 110 when the load current Io is greater than zero. When the output voltage Vo of the power supply 100 is the second voltage 24V and the load current Io is greater than zero, it indicates that the load 180 is the 24V LED lamp. The output voltage Vo is thus maintained as the second voltage 24V.

Figure 3:
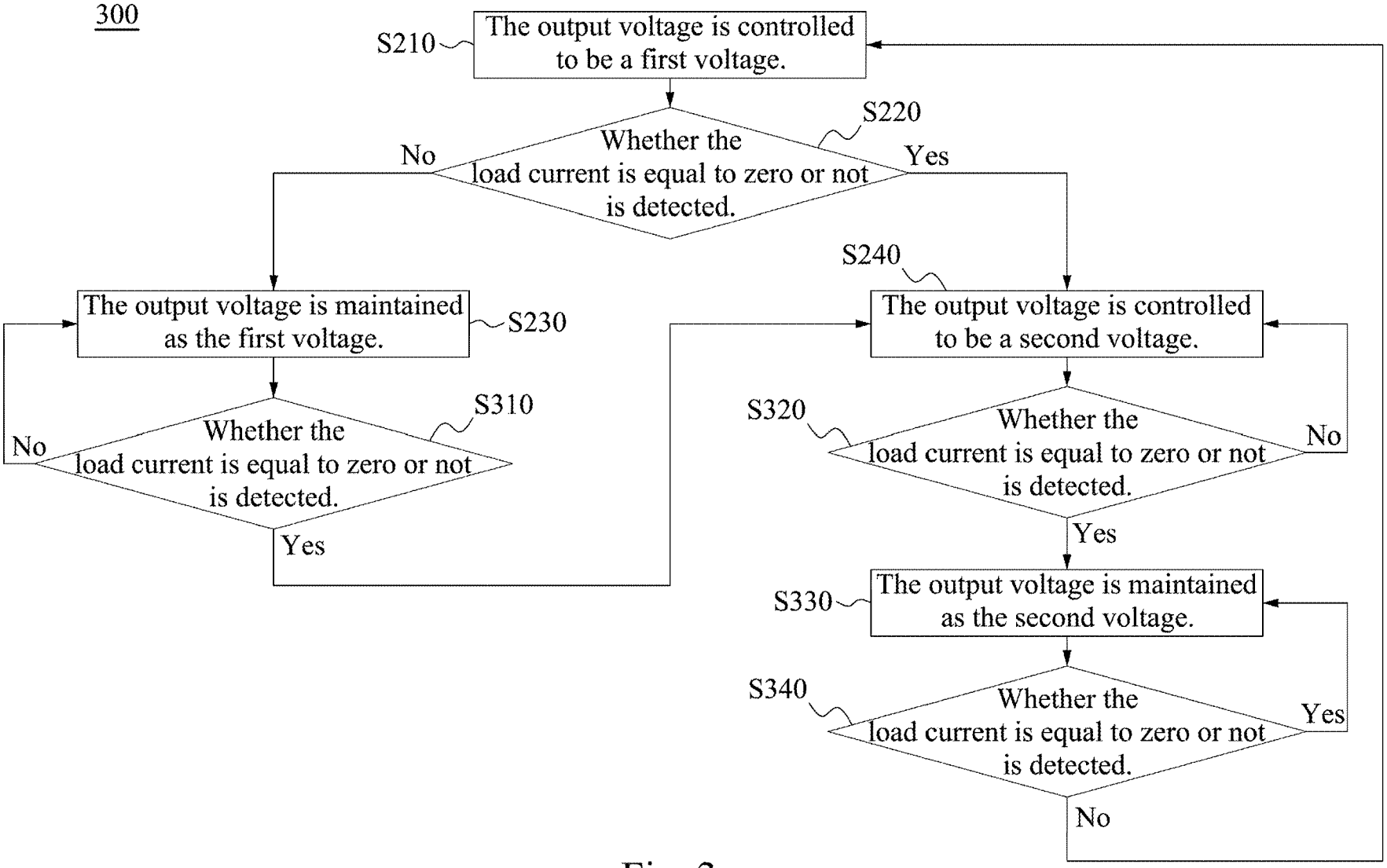
FIG. 3 depicts a flowchart of an operating method according to one embodiment of the present disclosure.

A description is provided with reference to FIG. 3. FIG. 3 depicts a flowchart of an operating method 300 according to one embodiment of the present disclosure. In order to facilitate the understanding of the operating method 300 shown in FIG. 3, a description is provided with reference to FIG. 1. The operating method 300 includes step S210, step S220, step S230, step S240, step S310, step S320, step S330, and step S340.

Since steps S210 to S240 shown in FIG. 3 are the same as steps S210 to S240 of the operating method 200 shown in FIG. 2, a description in this regard is not provided. Step S310 is executed after step S230 to detect whether the load current Io is equal to zero or not. When the load current Io is not equal to zero, it indicates that the load 180 is the 12V LED lamp. The process returns to step S230 to maintain the output voltage Vo as the first voltage 12V. When the load current Io is equal to zero, it indicates that the load 180 is not the 12V LED lamp. Step S240 is executed to control the output voltage Vo to be the second voltage 24V.

Then, whether the load current Io is equal to zero or not is detected in step S320. If the load current Io is not equal to zero, it indicates that the load 180 is not the 24V LED lamp. The process returns to step S240 to continue controlling the output voltage Vo to be the second voltage 24V.

If the load current Io is equal to zero in step S320, it indicates that the power supply 100 is currently in a no-load state, in other words, there is no load 180. Step S330 is executed to maintain the output voltage Vo as the second voltage 24V. After that, step S340 is executed to detect whether the load current Io is equal to zero or not. If the load current Io is equal to zero, the process returns to step S330 to continue maintaining the output voltage Vo as the second voltage 24V. If the load current Io is not equal to zero, step S210 is executed to control the output voltage Vo to be the first voltage 12V.

Figure 4:
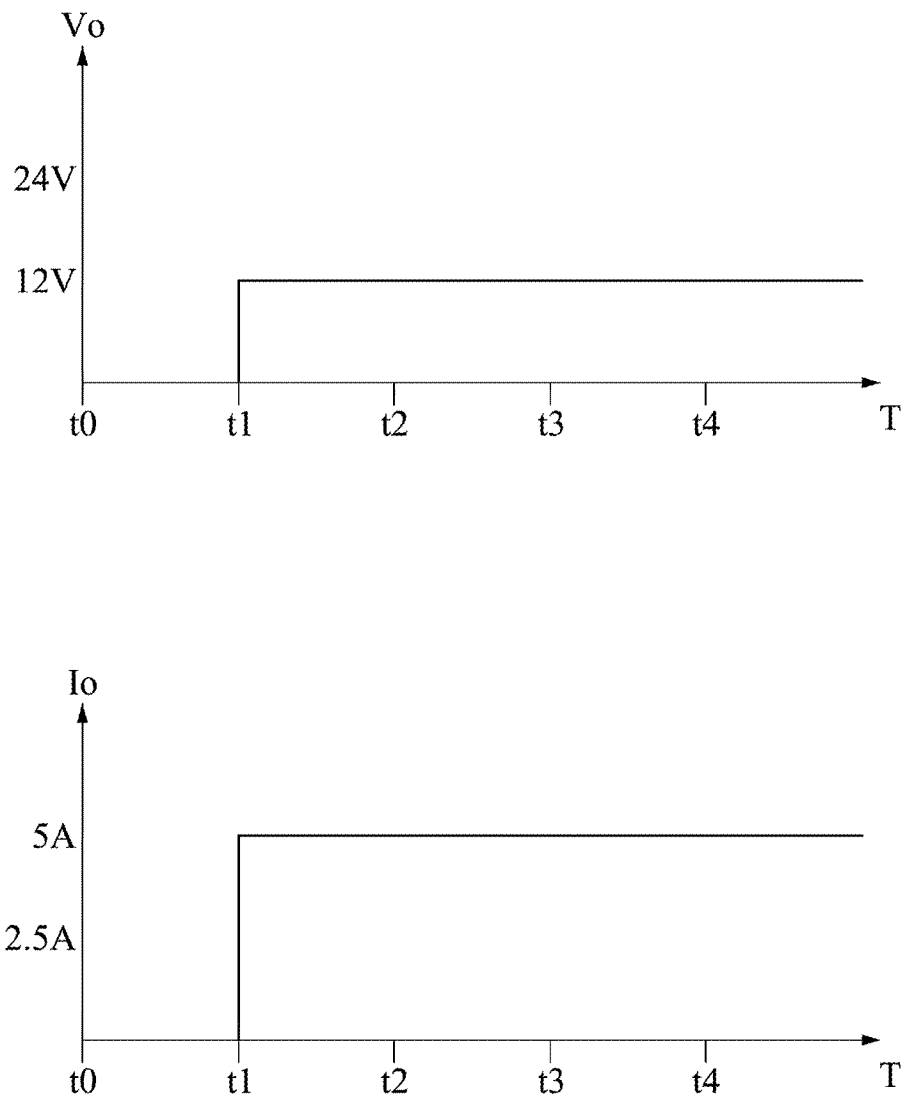
FIG. 4 depicts a timing diagram of an output voltage and a load current according to one embodiment of the present disclosure.

A description is provided with reference to FIG. 4. FIG. 4 depicts a timing diagram of the output voltage Vo and the load current Io according to one embodiment of the present disclosure. In general, if the load 180 connected to the power supply 100 is the 12V LED lamp and the power supply 100 is started with the output voltage Vo being the first voltage 12V, the power supply 100 detects the load current Io after the startup and then maintains a 12V constant voltage output.

Figure 5:
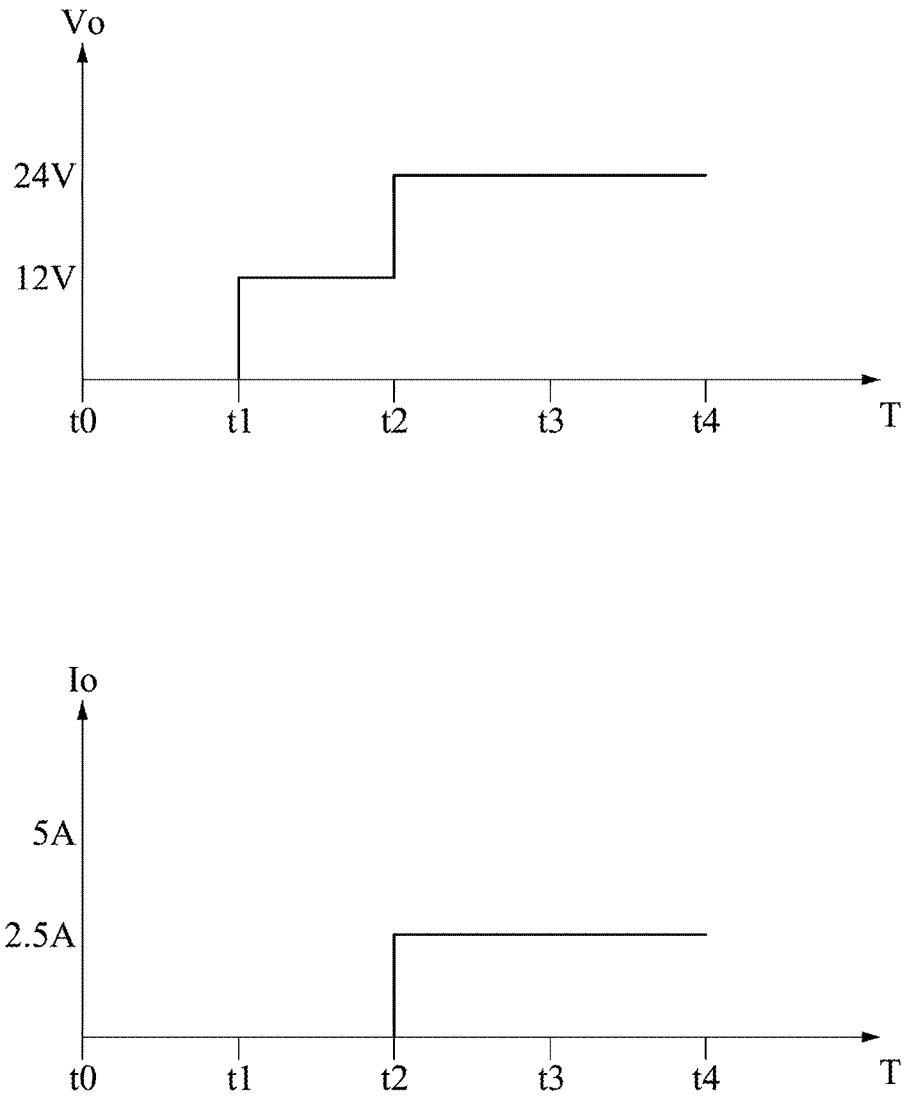
FIG. 5 depicts a timing diagram of an output voltage and a load current according to one embodiment of the present disclosure.

A description is provided with reference to FIG. 5. FIG. 5 depicts a timing diagram of the output voltage Vo and the load current Io according to one embodiment of the present disclosure. In general, if the load 180 connected to the power supply 100 is the 24V LED lamp and the power supply 100 is started with the output voltage Vo being the first voltage 12V, the power supply 100 detects that there is no load current Io between time t1 and time t2 after the startup, and automatically raises the output voltage Vo to the second voltage 24V. After the output voltage Vo is adjusted to 24V, a constant voltage output of the second voltage 24V is maintained after the load current Io is detected.

In one embodiment, the power supply 100 may be designed to switch the output voltage Vo after delaying for a period of time depending on practical situations and needs. For example, in order to avoid the dangerous situation caused by the power supply 100 being switched too frequently, the power supply 100 raises the output voltage Vo to the second voltage 24V after delaying for the period of time when the power supply 100 detects that that there is no load current Io between time t1 and time t2 after the startup. For example, the time for the power supply 100 to switch the voltage is designed to be 2 seconds. When the power supply 100 performs the operation of raising the output voltage Vo to the second voltage 24V, the output voltage Vo is raised to the second voltage 24V after a delay of 2 seconds.

Figure 6:
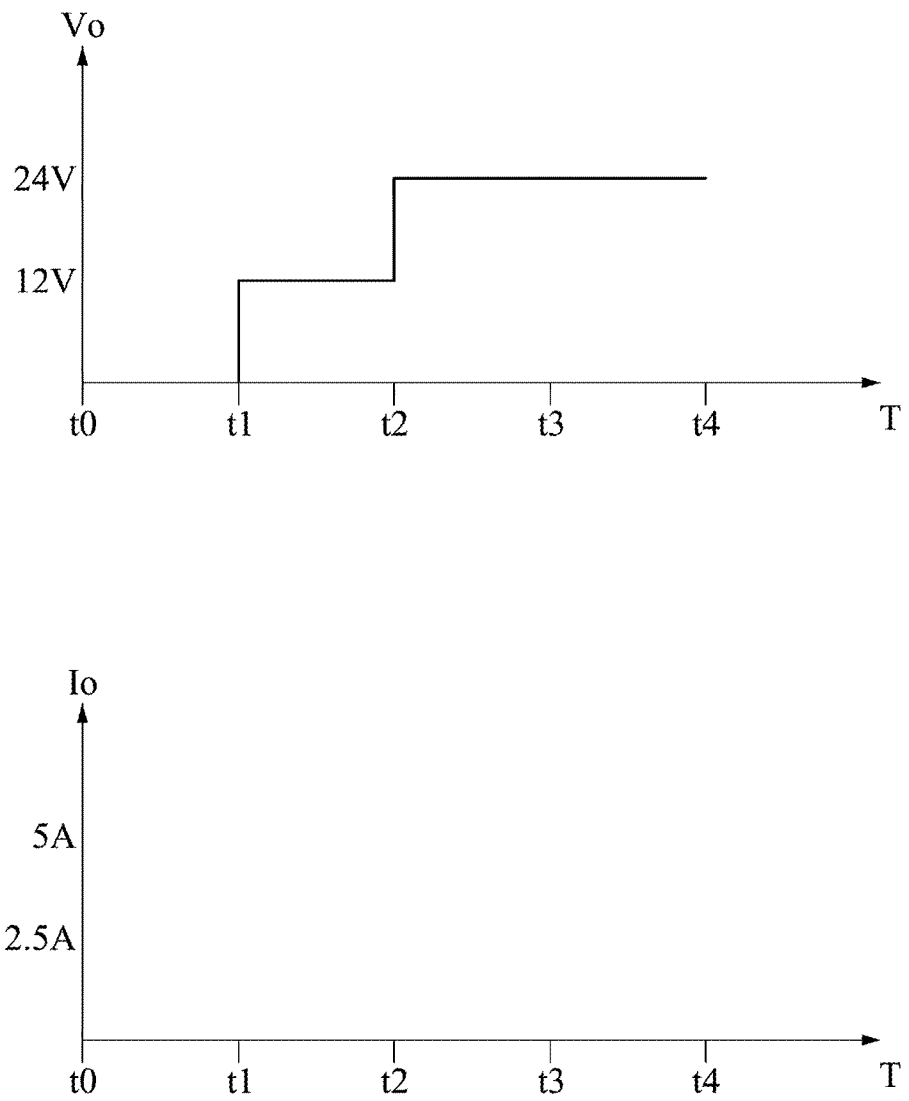
FIG. 6 depicts a timing diagram of an output voltage and a load current according to one embodiment of the present disclosure.

A description is provided with reference to FIG. 6. FIG. 6 depicts a timing diagram of the output voltage Vo and the load current Io according to one embodiment of the present disclosure. Under the circumstance of no load, if the power supply 100 is started without the load 180 and the power supply 100 is started with the output voltage Vo being the first voltage 12V, the power supply 100 detects that there is no load current Io between time t1 and time t2 after the startup, and automatically raises the output voltage Vo to the second voltage 24V. After the output voltage Vo is adjusted to the second voltage 24V, the power supply 100 maintains the constant voltage output of the second voltage 24V if there is still no load current Io being detected between time t2 and time t3. In some embodiments, the power supply 100 may be designed to switch the output voltage Vo after delaying for a period of time depending on practical situations and needs.

Figure 7:
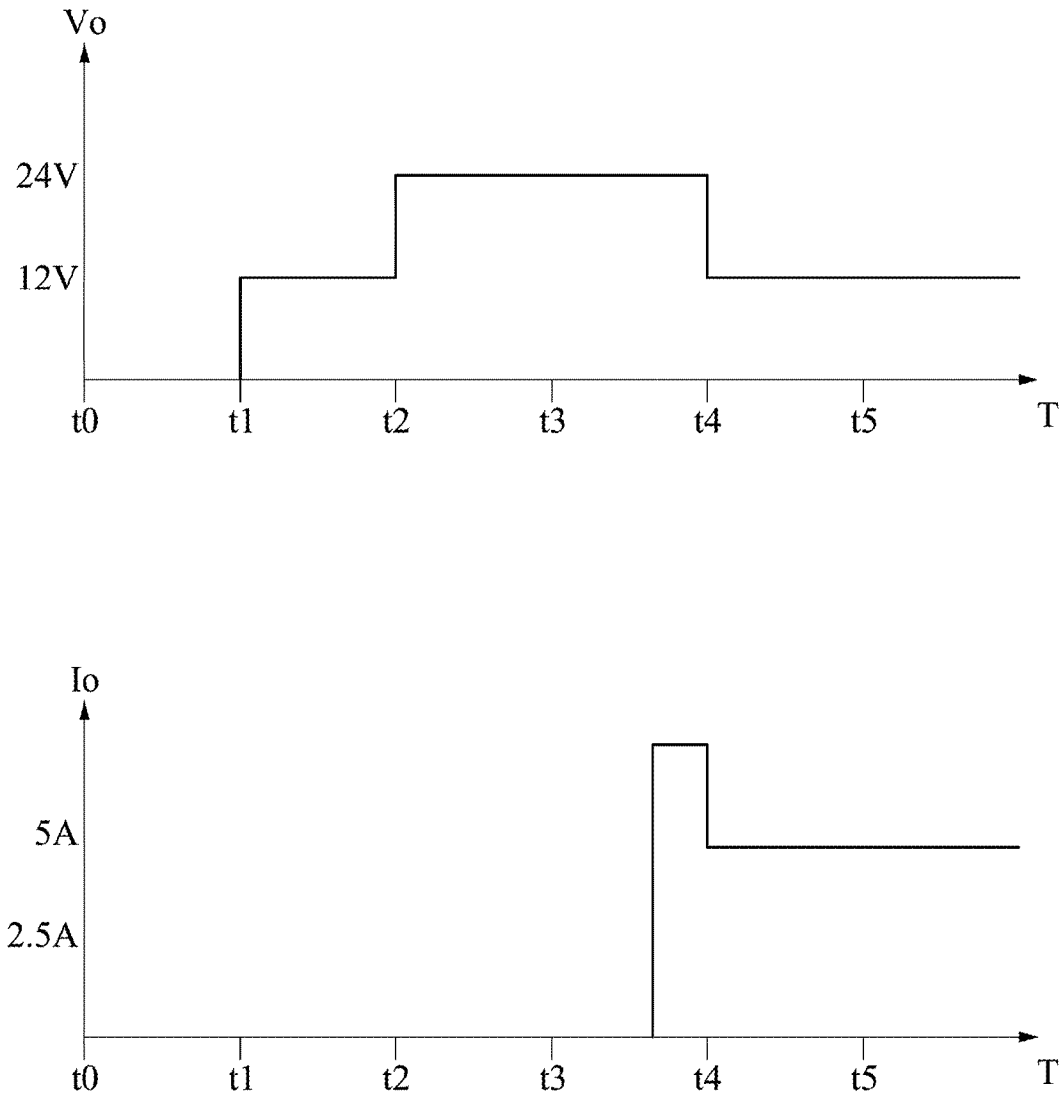
FIG. 7 depicts a timing diagram of an output voltage and a load current according to one embodiment of the present disclosure.

A description is provided with reference to FIG. 7. FIG. 7 depicts a timing diagram of the output voltage Vo and the load current Io according to one embodiment of the present disclosure. The 12V LED lamp is connected to be the load 180 under the circumstance of no load. The power supply 100 continuously outputs the second voltage 24V between time t3 and time t4 under the circumstance of no load. At this time, if the load current Io is detected, the output voltage Vo is immediately adjusted from the second voltage 24V to the first voltage 12V and is output. After the power supply 100 detects the load current Io, it indicates that the output voltage Vo matches the load 180, so that the power supply 100 maintains a constant voltage output of the first voltage 12V.

Figure 8:
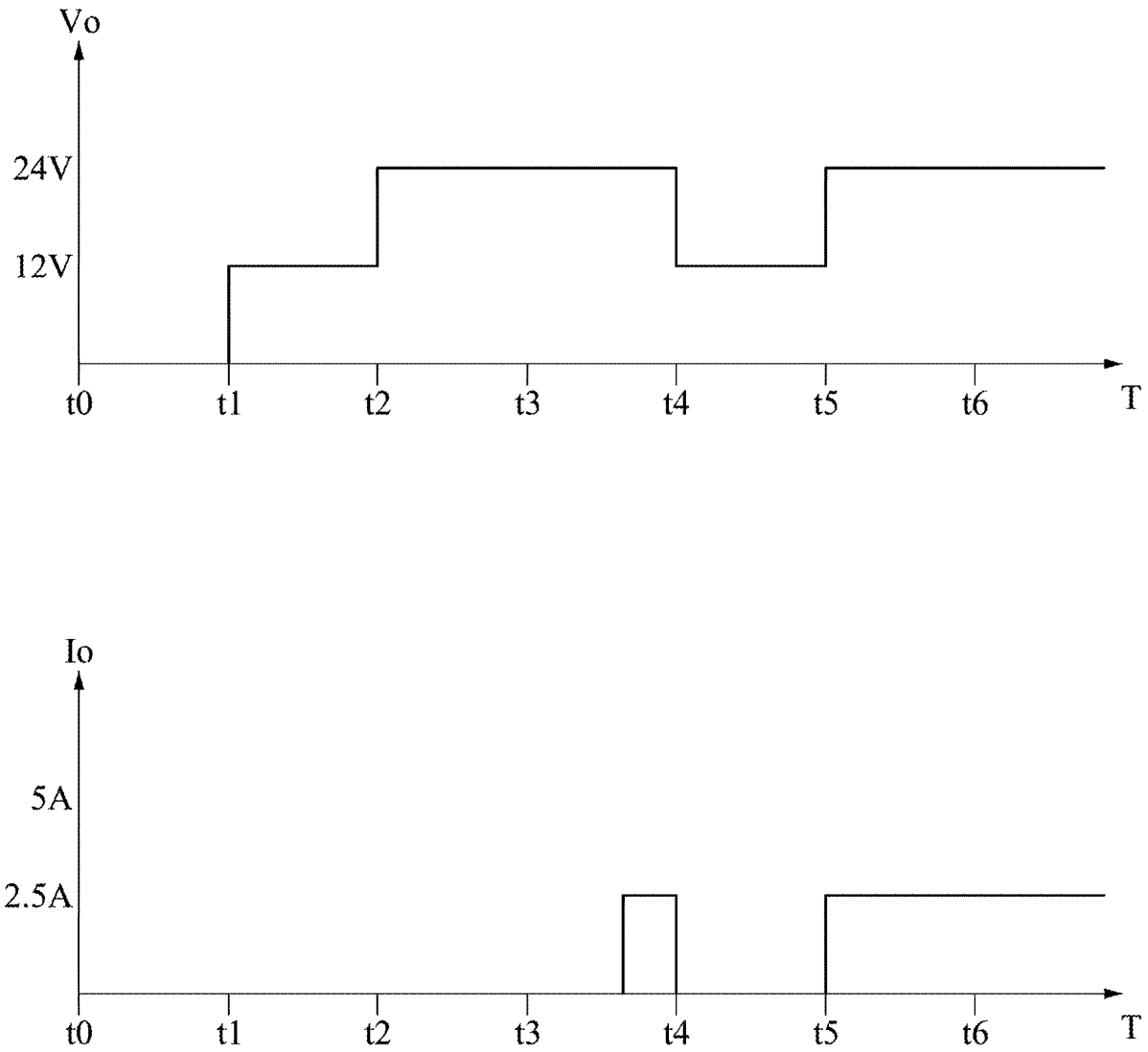
FIG. 8 depicts a timing diagram of an output voltage and a load current according to one embodiment of the present disclosure.

A description is provided with reference to FIG. 8. FIG. 8 depicts a timing diagram of the output voltage Vo and the load current Io according to one embodiment of the present disclosure. The 24V LED lamp is connected to be the load 180 under the circumstance of no load. The power supply 100 continuously outputs the second voltage 24V between time t3 and time t4 under the circumstance of no load. If the load current Io is detected, the output voltage Vo is immediately adjusted from the second voltage 24V to the first voltage 12V. When the power supply 100 detects that there is no load current Io between time t4 and time t5, it indicates that the current output voltage Vo does not match the load 180. After that, the output voltage Vo is raised to the second voltage 24V. After the output voltage Vo is adjusted to the second voltage 24V, the load current Io is detected to indicate that the output voltage Vo matches the load 180. The power supply 100 thus maintains the constant voltage output of the second voltage 24V. In some embodiments, the power supply 100 may be designed to switch the output voltage Vo after delaying for a period of time depending on practical situations and needs.

When the load 180 is formed by connecting more LED lamps in parallel, the total resistance will be smaller. According to the Ohm's law, the current passing through a conductor is proportional to the voltage across two ends of the conductor and inversely proportional to the resistance of the conductor. Therefore, the load current Io becomes larger. When the load current Io exceeds the rated current, the dangerous situation of burning out the electrical appliance is caused. In order to avoid this situation, when the load current Io is greater than the rated current, the output voltage Vo is changed to be controlled by the constant voltage control circuit 110 in the power supply 100. For example, the rated specification for the power supply 100 is 12V/60 W and the LED lamp is a 12V/1 W LED lamp, the output voltage Vo is changed to be controlled by the constant voltage control circuit 110 in the power supply 100 when more than 60 LED lamps are connected in parallel, so that the load current Io does not exceed the rated current 5 A.

In summary, the power supply detects whether there is the load current or not to determine the current Ioading situation, and then controls the output voltage to be the first voltage or the second voltage. As a result, the power supply can automatically correspond to different loads with different rated voltages without having to prepare different power supplies or transformers for different loads, thus resolving the annoyance and troubles when being used.

In addition, when the user simultaneously uses a large amount of load, the power supply can also respond to the change of the load to instantly control the output voltage, so as to control the load current not to exceed the rated current. The dangerous situation in which the circuit is burned out or the electrical appliance is damaged due to the simultaneous use of a large number of electrical appliances is avoided.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. An operating method for a light-emitting diode power supply comprising:

controlling an output voltage to be a first voltage by a control circuit;

detecting a load current by a detection circuit; and maintaining the output voltage as the first voltage by a constant voltage control circuit when the load current is greater than zero, and changing the output voltage from the first voltage to a second voltage by the control circuit when the load current is equal to zero, wherein the second voltage is greater than the first voltage.

2. The operating method of claim 1, further comprising:

detecting the load current when the output voltage is changed from the first voltage to the second voltage, and maintaining the output voltage as the second voltage by the constant voltage control circuit when the load current is greater than zero.

3. An operating method for a light-emitting diode power supply comprising:

controlling an output voltage to be a first voltage by a control circuit;

detecting a load current by a detection circuit;

changing the output voltage from the first voltage to a second voltage by the control circuit when the load current is equal to zero, wherein the second voltage is greater than the first voltage; and detecting the load current when the output voltage is changed from the first voltage to the second voltage, and maintaining the output voltage as the second voltage by a constant voltage control circuit when the load current is equal to zero.

4. The operating method of claim 3, further comprising:

detecting the load current when the output voltage is maintained as the second voltage, and changing the output voltage from the second voltage to the first voltage by the control circuit when the load current is greater than zero.

5. The operating method of claim 4, further comprising:

detecting the load current when the output voltage is changed from the second voltage to the first voltage, and maintaining the output voltage as the first voltage by the constant voltage control circuit when the load current is greater than zero.

6. The operating method of claim 4, further comprising:

detecting the load current when the output voltage is changed from the second voltage to the first voltage, and changing the output voltage from the first voltage to the second voltage by the control circuit when the load current is equal to zero.

7. A power supply for a light-emitting diode comprising:

a constant voltage control circuit configured to control an output voltage of the power supply to be a first voltage or a second voltage, wherein the second voltage is greater than the first voltage;

a detection circuit configured to detect a load current; and a control circuit configured to control the constant voltage control circuit so as to change the output voltage to the first voltage or the second voltage according to the load current;

wherein when the output voltage is the first voltage, the constant voltage control circuit maintains the output voltage as the first voltage if the load current is greater than zero, and the control circuit changes the output voltage from the first voltage to the second voltage if the load current is equal to zero.

8. The power supply of claim 7, wherein the detection circuit detects the load current when the output voltage is changed from the first voltage to the second voltage, and the constant voltage control circuit maintains the output voltage as the second voltage when the load current is equal to zero.

9. The power supply of claim 8, wherein the detection circuit detects the load current when the output voltage is maintained as the second voltage, and the control circuit changes the output voltage from the second voltage to the first voltage when the load current is greater than zero.

10. The power supply of claim 9, wherein the detection circuit detects the load current when the output voltage is changed from the second voltage to the first voltage, and the constant voltage control circuit maintains the output voltage as the first voltage when the load current is greater than zero.

11. The power supply of claim 9, wherein the detection circuit detects the load current when the output voltage is changed from the second voltage to the first voltage, and the control circuit changes the output voltage from the first voltage to the second voltage when the load current is equal to zero.

12. The power supply of claim 7, further comprising:

a constant current control circuit configured to control the output voltage according to the load current so that the load current does not exceed a rated current.

* * * * *